US007237457B2

(12) United States Patent
Hsu

(10) Patent No.: US 7,237,457 B2
(45) Date of Patent: Jul. 3, 2007

(54) SCREW FEEDER ADAPTER FOR A POWER SCREWDRIVER

(75) Inventor: Ming-Hung Hsu, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 59 days.

(21) Appl. No.: 11/294,576

(22) Filed: Dec. 6, 2005

(65) Prior Publication Data

US 2007/0128933 A1 Jun. 7, 2007

(51) Int. Cl.
*B25B 17/00* (2006.01)

(52) U.S. Cl. ..... 81/57.3; 81/54; 81/434

(58) Field of Classification Search ..... 81/57.3, 81/54, 434

See application file for complete search history.

(56) References Cited

U.S. PATENT DOCUMENTS 6,647,836 B1 * 11/2003 Habermehl ..... 81/434
6,769,332 B2 * 8/2004 Muro ..... 81/434

* cited by examiner

*Primary Examiner*—Joseph J. Hail, III
*Assistant Examiner*—Shantese McDonald
(74) *Attorney, Agent, or Firm*—Bacon & Thomas, PLLC

(57) ABSTRACT

A screw feeder adapter includes a housing having a first connecting portion for connection to a screw feeder, a second connecting portion, and a retaining portion connected between the first connecting portion and the second connecting portion, a coupling member connectable to a power screwdriver and coupled to the second connecting portion of the housing through a rotary motion, and two locking units respectively pivoted to the retaining portion of the housing at two sides and forced by a respective spring member to engage into a respective retaining hole at the housing and a respective retaining groove at the coupling member to lock the coupling member to the housing.

8 Claims, 5 Drawing Sheets

SCREW FEEDER ADAPTER FOR A POWER SCREWDRIVER

BACKGROUND OF THE INVENTION

1. Field of the Invention

The present invention relates to power hand tools and more particularly, to a screw feeder adapter for detachably connecting a screw feeder to a power screwdriver.

2. Description of the Related Art

When proceeding with a screw fastening or unfastening task, a manual screwdriver or a power screwdriver may be used. Further, when performing a task that requires installation of a big amount of screws, a screw feeder or screw magazine may be used with a power screwdriver so that screws can be automatically fed into the power screwdriver and quickly driven into the workpiece with the power screwdriver. According to a conventional design, the connection between a screw feeder and a power screwdriver is done through a lock nut. However, it takes much time to connect the screw feeder to the power screwdriver with the lock nut and to rotate the lock nut to the locking position. When wishing to detach the screw feeder from the power screwdriver, it also takes much time to rotate the lock nut from the locking position to the unlocking position and then to disconnect the screw feeder and the lock nut from the power screwdriver.

SUMMARY OF THE INVENTION

The present invention has been accomplished under the circumstances in view. It is therefore one object of the present invention to provide a screw feeder adapter, which can quickly and detachably be installed to connect a screw feeder to a power screwdriver.

To achieve this object of the present invention, the screw feeder adapter for detachably connecting a screw feeder to a power screwdriver comprises a housing, a coupling member, and two locking units. The housing has a first connecting portion for connecting to the screw feeder, a second connecting portion, a retaining portion connected between the first connecting portion and the second connecting portion, a receiving open chamber axially extending through the first connecting portion, the retaining portion and the second connecting portion, two retaining holes respectively formed in the retaining portion at two opposite lateral sides in communication with the receiving open chamber, and two inside locating blocks respectively projecting from an inside wall of the second connecting portion. The coupling member is connected the second connecting portion of the housing to the power screwdriver. The coupling member has two locating structures disposed at two opposite lateral sides thereof for coupling to the inside locating blocks of said housing, and two retaining grooves respectively disposed adjacent to the locating structures. The locking units are respectively pivotally coupled to the retaining portion of the housing and engageable into the retaining holes of the housing and the retaining grooves of the coupling member to lock the coupling member to the housing.

DETAILED DESCRIPTION OF THE INVENTION

Figure 1:
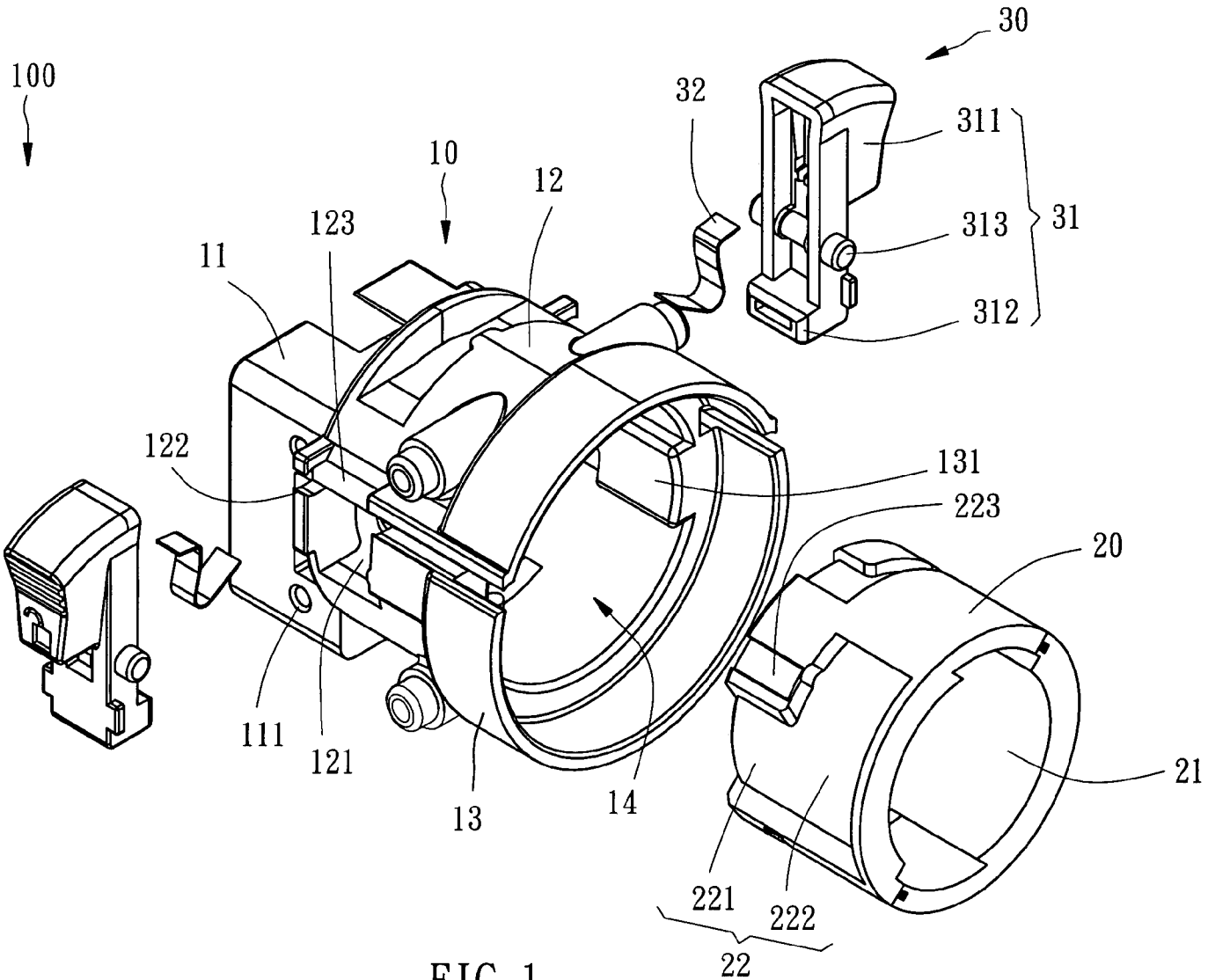
FIG. 1 is an exploded view of a screw feeder adapter for a power screwdriver according to a preferred embodiment of the present invention.
Figure 2:
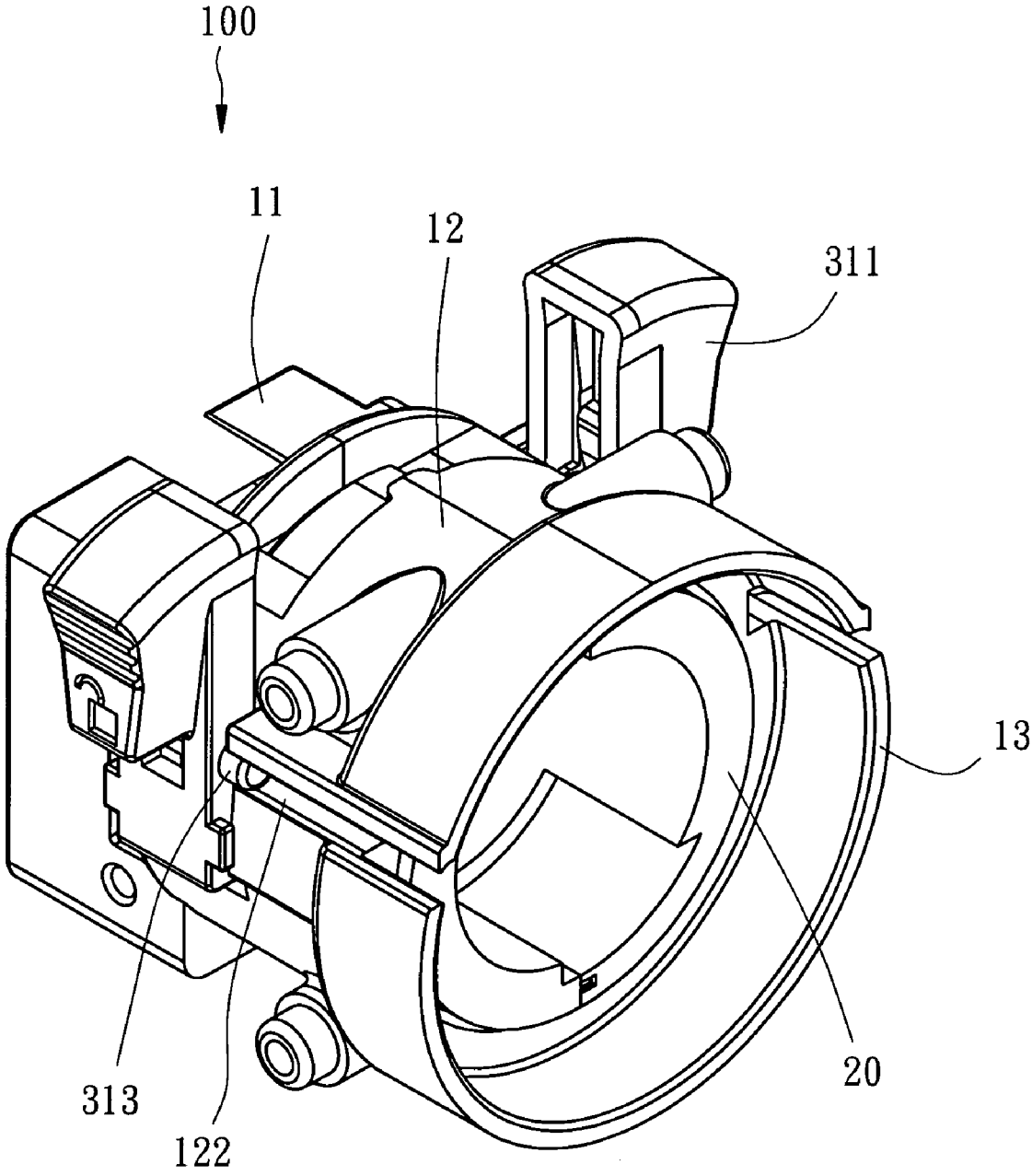
FIG. 2 is a perspective assembly view of the screw feeder adapter according to the preferred embodiment of the present invention.

Referring to FIGS. 1 and 2, a screw feeder adapter 100 in accordance with the preferred embodiment of the present invention is shown comprising a housing 10, a coupling 20, and two locking units 30.

The housing 10 is made in integrity, having a first connecting portion 11, a retaining portion 12 and a second connecting portion 13. The retaining portion 12 has two ends respectively connected to the first connecting portion 11 and the second connecting portion 12, i.e., the retaining portion 12 is disposed between the first connecting portion 11 and the second connecting portion 13. The first connecting portion 11, the second connecting portion 13 and the retaining portion 12 define an axially extending receiving open chamber 14, i.e., the receiving open chamber 14 extends through the free ends of the first connecting portion 11 and second connecting portion 13 in communication with the outside of the housing 10.

The first connecting portion 11 is a hollow rectangular structure surrounding the receiving open chamber 14, having a plurality of lock holes 111 in the peripheral wall thereof.

The retaining portion 12 is a hollow member surrounding the receiving open chamber 14 and connected between the first connecting portion 11 and the second connecting portion 13, having a retaining hole 121 disposed at each of the two opposite lateral sides thereof, two coupling grooves 122 disposed at each of the two opposite lateral sides above the retaining hole 121, and a bearing member (for example, a suspension rod) 123 disposed at each of the two opposite lateral sides right above the respective retaining hole 121 and spaced between the respective coupling grooves 122.

The second connecting portion 13 has a circular cross section surround the receiving open chamber 14 and is connected to one end of the retaining portion 12 opposite to the first connecting portion 11. Further, the second connecting portion 13 has two locating blocks 131 bilaterally protruding from the inside wall.

The coupling member 20 is shaped like a barrel defining an axially extending coupling hole 21, having two substantially L-shaped locating structures 22 symmetrically disposed on the outside wall at two opposite lateral sides. Each locating structure 22 comprises a guide groove 221, which extends axially from one end of the outside wall of the coupling member 20, and a positioning groove 222 perpendicularly extending from one end of the guide groove 221. The coupling member 20 further has two retaining grooves 223 respectively formed on the outside wall thereof adjacent to the guide grooves 221 of the locating structure 22 respectively.

The locking units 30 each are comprised of a locking member 31 and a spring member 32. The locking member 31 is pivotally connected to the housing 10 and turnable relative to the housing 10 between a locking position and an unlock ing position. The locking member 31 has a handle 311 at one end, a locking tip 312 at the other end, and a connecting portion, for example, a pivot rod 313 on the middle between the handle 311 and the locking tip 312. The handle 311 and the locking tip 312 respectively extend from the two distal ends of the locking member 31 in reversed directions.

The assembly process of the screw feeder adapter 100 is simple and outlined hereinafter with reference to FIGS. 1 and 2 again. The spring members 32 of the two locking units 30 are curved spring plates respectively inserted through the gaps between the peripheral wall of the retaining portion 12 and the bearing members 123 and attached to the periphery of the bearing members 123, and then the pivot rods 313 of the locking members 31 are respectively pivotally coupled to the coupling grooves 122 of the retaining portion 12 to have the two distal ends of each of the spring members 32 be respectively stopped against the outside wall of the retaining portion 12 of the housing 10 and the inside wall of each of the locking members 31. By means of the spring force of the spring members 32, the locking members 31 are held in the locking position where the locking tips 312 of the locking members 31 are respectively inserted through the retaining holes 121 into the receiving open chamber 14.

Figure 3:
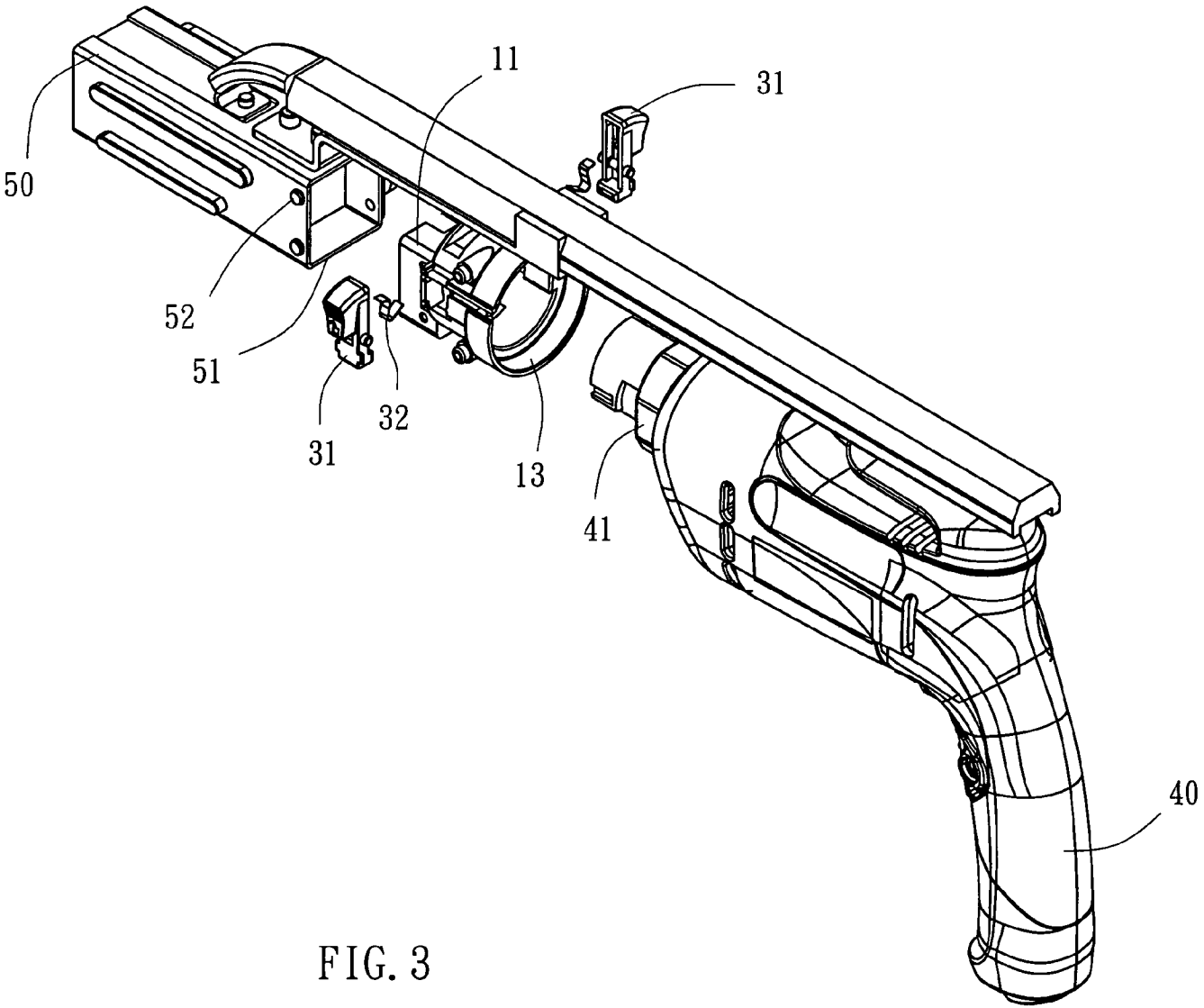
FIG. 3 is a schematic drawing showing the invention in use.
Figure 4:
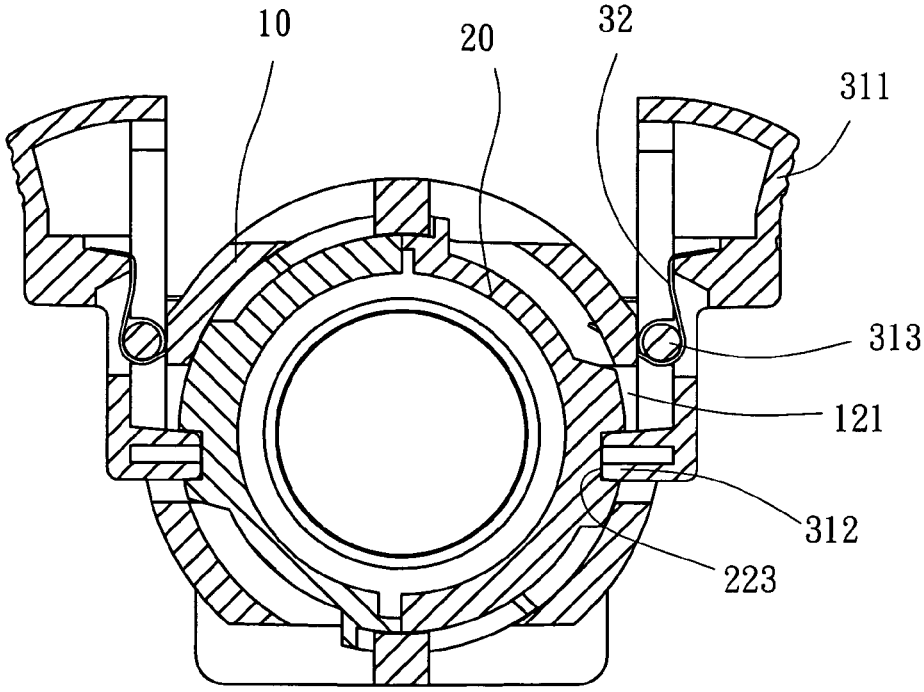
FIG. 4 is a sectional view of the present invention, showing the screw feeder adapter locked.

The use of the present invention is outlined hereinafter with reference to FIGS. 3 and 4 and FIGS. 1 and 2 again. The coupling hole 21 of the coupling member 20 is press-fitted onto the coupling end 41 of the power screwdriver 40, and then the coupling member 20 is inserted into the receiving open chamber 14 within the second connecting portion 13 for enabling the locating blocks 131 of the second connecting portion 13 to be respectively inserted into the guide grooves 221 of the locating structures 22 of the coupling member 20, and then the housing 10 and the coupling member 20 are rotated relative to each other through an angle to move the locating blocks 131 into the positioning grooves 222 of the locating structures 22 respectively to further prohibit relative movement in axial direction between the housing 10 and the coupling member 20. At this time, the retaining grooves 223 of the coupling member 20 are forced into engagement with the locking tips 312 of the locking members 31, and therefore the locking members 31 lock the coupling member 20 to the housing 10. Thereafter, the first connecting portion 11 of the housing 10 is inserted into the coupling end 51 of the screw feeder 50. Upon insertion of the first connecting portion 11 of the housing 10 to the coupling end 51 of the screw feeder 50, the spring pins 52 of the screw feeder 50 automatically engage into the lock holes 111 to lock the screw feeder 50 to the housing 10. Thus, the screw feeder adapter 100 connects the screw feeder 50 to the power screwdriver 40.

Figure 5:
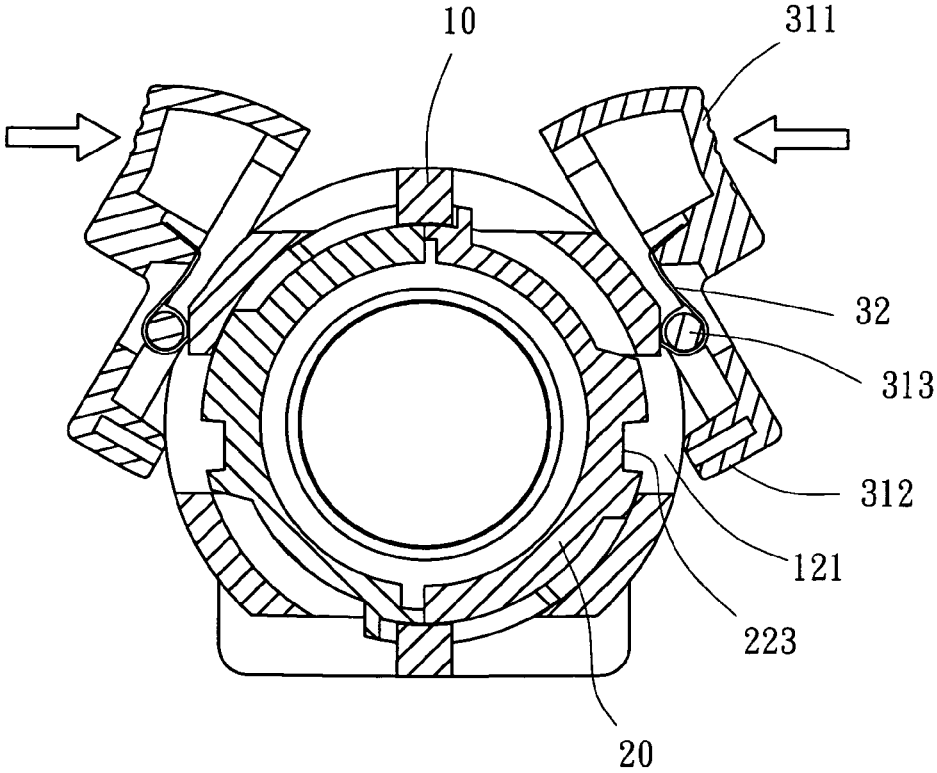
FIG. 5 is a sectional view of the present invention, showing the screw feeder adapter unlocked.
Figure 6:
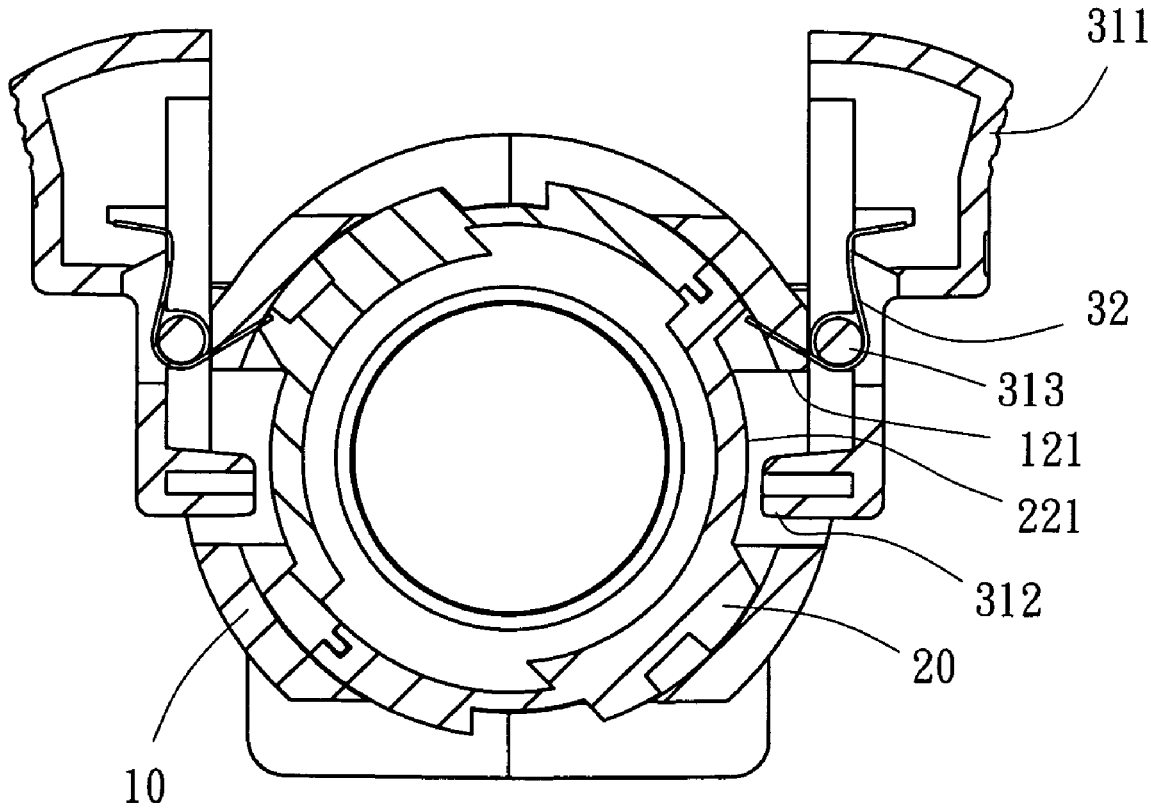
FIG. 6 is a sectional view of the present invention, showing the detachable status of the screw feeder adapter.

When wishing to detach the screw feeder adapter 100 from the screw feeder 50 and the power screwdriver 40, press the handles 311 of the locking members 31 to bias the locking members 31 relative to the housing 10 and to move the locking members 31 from the locking position to the unlocking position where the locking tips 312 are respectively disengaged from the respective retaining grooves 223 (see FIG. 5), and then rotate the coupling member 20 relative to the housing 10 in the reversed direction to move the locating blocks 131 out of the respective positioning grooves 222 into the respective guide grooves 221. At this time, the coupling member 20 is unlocked from the housing 10 and can be detached with the power screwdriver 40 from the housing 10. Thereafter, the housing 10 can be disconnected from the coupling end 51 of the screw feeder 50, and the coupling member 20 can be detached from the coupling end 41 of the power screwdriver 41.

In the aforesaid embodiment, the coupling member is an independent member. Alternatively, the coupling member can be formed integral with one end of the power screwdriver.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A screw feeder adapter for detachably connecting a screw feeder to a power screwdriver, the screw feeder adapter comprising:

a housing having a first connecting portion for connecting to the screw feeder, a second connecting portion, a retaining portion connected between said first connecting portion and said second connecting portion, a receiving open chamber axially extending through said first connecting portion, said retaining portion and said second connecting portion, two retaining holes respectively formed in said retaining portion at two opposite lateral sides in communication with said receiving open chamber, and two inside locating blocks respectively projecting from an inside wall of said second connecting portion;

a coupling member for connecting the second connecting portion of said housing to the power screwdriver, said coupling member having two locating structures disposed at two opposite lateral sides for coupling to the inside locating blocks of said housing, and two retaining grooves respectively disposed adjacent to said locating structures; and two locking units respectively pivotally coupled to said retaining portion of said housing and engageable into said retaining holes of said housing and said retaining grooves of said coupling member to lock said coupling member to said housing.

2. The screw feeder adapter as claimed in claim 1, wherein said housing comprises a plurality of lock holes formed in said first connecting portion for receiving a respective spring pin of a screw feeder to be attached to said first connecting portion of said housing.

3. The screw feeder adapter as claimed in claim 1, wherein said housing comprises a plurality of coupling grooves respectively formed in an outside wall of said retaining portion above said retaining holes; said locking units each comprise a connecting portion respectively pivotally coupled to the coupling grooves of said housing.

4. The screw feeder adapter as claimed in claim 1, wherein said housing comprises two bearing portions respectively provided outside said retaining portion at two opposite lateral sides; said locking units each comprise a locking member respectively pivotally coupled to said retaining portion of said housing and turnable relative to said housing between a locking position to lock said coupling member to said housing and an unlocking position for disconnection of said coupling member from said housing, and a spring member coupled to one of said bearing portions of said housing and stopped between said retaining portion of said housing and said locking member to hold said locking member in said locking position.

5. The screw feeder adapter as claimed in claim 4, wherein said locking member comprises a handle disposed at one end thereof for pressing by the user, a locking tip disposed at an opposite end thereof for engaging into one retaining hole of said housing and one retaining groove of said coupling member to lock said coupling member to said housing, and a connecting portion spaced between said handle and said locking tip and pivoted to said retaining portion of said housing.

6. The screw feeder adapter as claimed in claim 4, wherein the spring member of each of said two locking units is a curved spring plate.

7. The screw feeder adapter as claimed in claim 1, wherein said coupling member has a coupling hole for coupling to a power screwdriver.

8. The screw feeder adapter as claimed in claim 1, wherein said locating structures of said coupling member each comprise a guide groove, which extends axially from one end of said coupling member, and a positioning groove extending from one end of said guide groove for receiving one of said locating blocks of said housing to prohibit axial displacement of said housing relative to said coupling member after insertion of said locating blocks of said housing into the guide grooves of said locating structure and after a rotary motion of said housing relative to said coupling member.

* * * * *